US006530822B1

(12) United States Patent
Lin

(10) Patent No.: US 6,530,822 B1
(45) Date of Patent: Mar. 11, 2003

(54) METHOD FOR CONTROLLING POLISHING TIME IN CHEMICAL-MECHANICAL POLISHING PROCESS

(75) Inventor: Jiunn-Yi Lin, Taipei (TW)

(73) Assignee: United Microelectronics Corp., Hsin-Chu City (TW)

( * ) Notice: Subject to any disclaimer, the term of this patent is extended or adjusted under 35 U.S.C. 154(b) by 0 days.

(21) Appl. No.: 09/477,114

(22) Filed: Dec. 31, 1999

(51) Int. Cl.[7] ..... B24B 1/00

(52) U.S. Cl. ..... 451/11; 451/41; 451/54; 451/59; 216/89; 438/692

(58) Field of Search ..... 451/41, 8, 9, 10, 451/11, 54, 59; 216/88, 89; 438/691, 692, 693

(56) References Cited

U.S. PATENT DOCUMENTS 5,695,601 A * 12/1997 Kodera et al. ..... 156/636.1
5,738,574 A * 4/1998 Tolles et al. ..... 451/41
5,830,041 A * 11/1998 Takahashi et al. ..... 451/41
6,086,457 A * 7/2000 Perlov et al. ..... 451/41
6,113,462 A * 9/2000 Yang ..... 451/5
6,117,780 A * 9/2000 Tsai et al. ..... 438/692

* cited by examiner

*Primary Examiner*—Eileen P. Morgan

(57) ABSTRACT

A method for controlling polishing time in chemical-mechanical polishing process is disclosed. The method comprises mainly the following steps. An initial polishing rate, a reference removal thickness, a reference pre-thickness and a target thickness are provided firstly. A first wafer including a first layer is subsequently provided. After measuring the thickness of the first layer, the result as a first pre-thickness is then obtained. The difference between the reference pre-thickness and the first pre-thickness is so-called the first pre-variability. A first removal thickness is found by adding the first pre-variability to the reference removal thickness. after dividing the first removal thickness by the initial polishing rate, a first polishing time is obtained. The first layer of the first wafer is treated by chemical-mechanical polishing for the period of the first polishing time. Then, the thickness of said second layer is measured, and the result is the so-called a second post-thickness. The difference between the target thickness and the second post-thickness is the so-called second post-variability. The second post-variability is divided by the second polishing time. The result is then added to the first polishing rate to form a second polishing rate.

6 Claims, 1 Drawing Sheet

METHOD FOR CONTROLLING POLISHING TIME IN CHEMICAL-MECHANICAL POLISHING PROCESS

BACKGROUND OF THE INVENTION

1. Field of the Invention

The present invention relates to a method for improving the chemical-mechanical polishing process in semiconductor manufacture, more particularly to the method for generating out the desired polishing time in the chemical-mechanical polishing process.

2. Description of the Prior Art

Chemical-mechanical polishing (CMP) is one of the common planarizing techniques. The method is used to achieve a planar surface over the entire chip and wafer, referred to as "global planarity". It consists of a rotating holder that holds the wafer, an appropriate slurry, and a polishing pad that is applied to the wafer at a specified pressure. CMP is not limited to dielectrics. It is used to planarize deep and shallow trenches filled with polysilicon or oxide, and various metal films.

Polishing results from a combination of chemical and mechanical effects. A suggested mechanism for CMP involves the formation of a chemically altered layer at the surface of the material being polished. This layer is mechanically removed from the surface, beginning the process again. For example, in $SiO_2$ polishing, the altered layer may be a hydrated oxide that can be mechanically removed or, for metal polishing, a metal oxide may be formed and removed.

In the general case of oxide chemical-mechanical polishing (CMP), the polishing time is found according to the following equation:

polishing time=removal thickness/polishing rate where removal thickness and polishing rate are constants. Accordingly the calculated polishing time is surely a constant. That is, every lot of the production wafers is put into the CMP apparatus and is polished for the same period of time due to the same values of removal thickness and polishing rate. The variability of the original thickness of oxide layers is not considered during the chemical-mechanical polishing process. The polishing rate is generally found from the periodic machine tests, in which the dummy wafer is employed. Then, every lot of production wafers sent into the polishing machine is polished under the set of the constant polishing rate for the rough constant polishing time. However, in the repetitionary chemical-mechanical polishing processes, the polishing rate is easily changed for reasons including the impact of some elements such as pads and dressers in the integrated circuits, and consuming of the polishing pad of the machine. In conventional procedures, to get an accurate polishing time, a greater number of machine tests should be done, and the production processes should certainly be paused more frequently. After that, unfortunately, the throughput will be reduced and the cost of ownership will be increased.

For the foregoing reasons, there is a need to develop a method for controlling the polishing time to a more accurate polishing time to enhance CMP quality.

SUMMARY OF THE INVENTION

In accordance with the present invention, a method is provided for finding an accuracy polishing time that substantially can improve CMP quality. The method comprises mainly the following step. An initial polishing rate, a reference removal thickness, a reference pre-thickness and a target thickness are provided firstly. A first wafer including a first layer is subsequently provided. After measuring the thickness of the first layer, the result as a first pre-thickness is then obtained. The difference between the reference pre-thickness and the first pre-thickness is the so-called first pre-variability. A first removal thickness is found by adding the first pre-variability to the reference removal thickness. After dividing the first removal thickness by the initial polishing rate, a first polishing time is obtained. The first layer of the first wafer is treated by chemical-mechanical polishing for the period of the first polishing time. Then, the thickness of the second layer is measured, and the result is the so-called second post-thickness. The difference between the target thickness and the second post-thickness is the so-called the second post-variability. The second post-variability is then divided by the second polishing time. The result is then added to the first polishing rate to form a first polishing rate. A second wafer is provided and includes a second layer. After measuring the thickness of the second layer, the result as a second pre-thickness is obtained. The difference between the reference pre-thickness and the second pre-thickness is the so-called second pre-variability. Subsequently, a second removal thickness is found by adding the second pre-variability to the reference removal thickness. After dividing the second removal thickness by the first polishing rate, a second polishing time is obtained. The second layer of the second wafer is then treated by chemical-mechanical polishing for the period of the second polishing time. The thickness of the second layer is measured and the result is the so-called second post-thickness. The difference between the target thickness and the second post-thickness is a second post-variability. After dividing the second post-variability by the second polishing time, the result is subsequently added to the first polishing rate to form a second polishing rate. The second polishing rate can be used to find the third polishing time. The principle can be expanded to the n-th term or above. The every predicted polishing time from the principle is more accuracy the conventional one. Accordingly, the CMP quality can be surely be enhanced.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
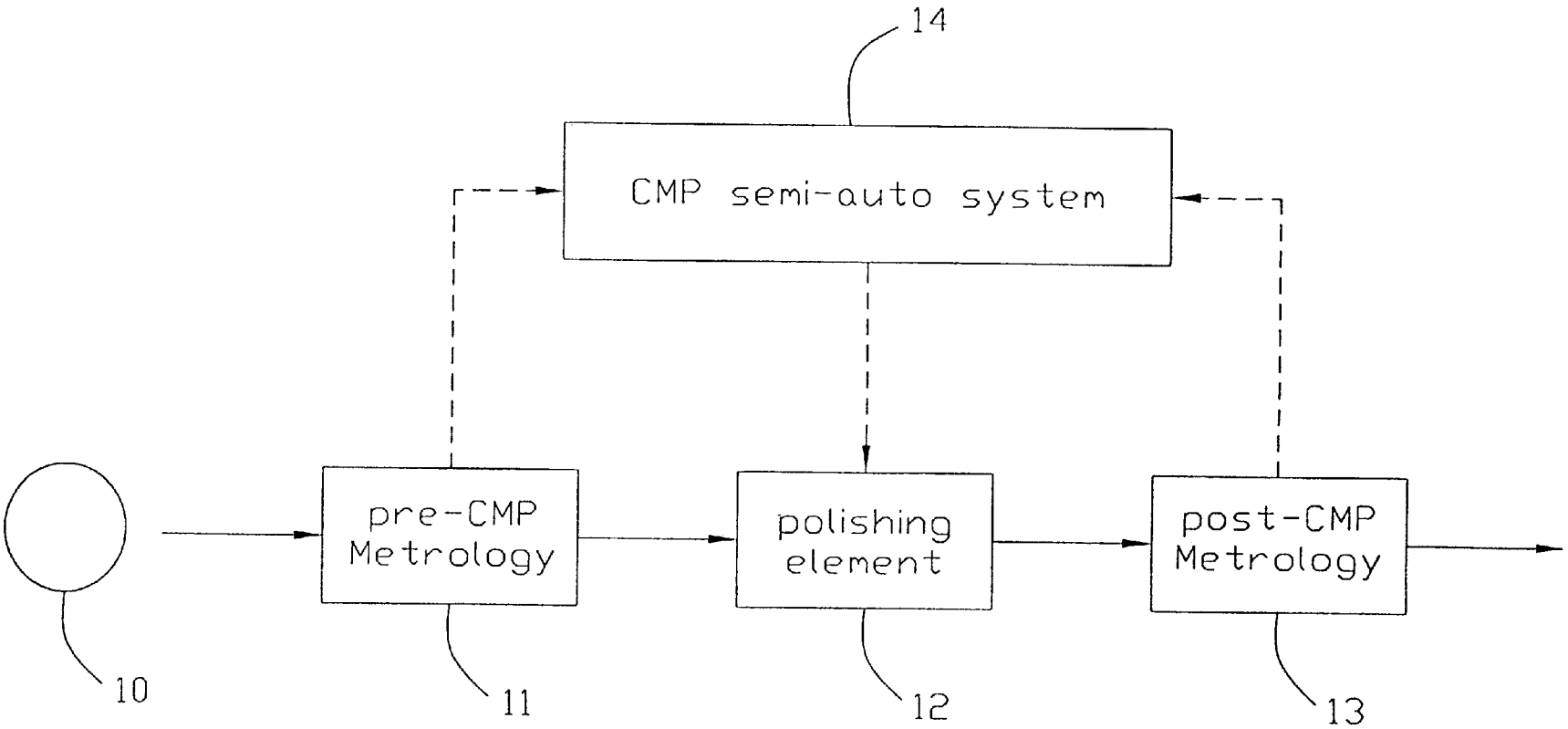
FIG. 1 shows the flow chart of the CMP process provided by the present invention.

The present invention provides modules to predict the polishing time for every lot of production wafers in the chemical-mechanical polishing (CMP) process. The polishing time is adaptable and should cooperate with the CMP semi-auto system during the chemical-mechanical polishing process. It substantially found from the following equation:

polishing time=removal thickness/polishing rate where removal thickness and polishing rate are variable the during chemical-mechanical polishing process.

In general semiconductor manufacture, before the chemical-mechanical polishing (CMP) process begins for the production wafer, dummy wafers are usually employed to test the CMP apparatus for predicting the polishing rate. On each of the dummy wafers a polishing-desired layer, such as an oxide, was already deposited. The predicted polishing rate serves as an initial polishing rate $RR_0$. Then, a few of production wafers, having thereon a polishing-desired layer with the same material as on the dummy wafers, are put into the CMP apparatus. Each of the production wafers has a thickness of $TK_{B0}$, the so-called reference pre-thickness. Subsequently, a CMP test run is implemented to polish the production wafers to the target thickness, $TK_{Target}$, and such hint at the polishing end-point. The polishing time is then multiplied by the initial polishing rate, with the result being the so-called reference removal thickness, $TK_0$.

Referring to FIG. 1, when producing work running in chemical-mechanical polishing process, a production wafer 10 is processed firstly to a pre-CMP metrology 11, where the thickness of the polishing-desired layer of the wafer is measured. The result is the so-called pre-thickness. The wafer is then processed into a polishing element 12 and is polished for planarization. Finally, the thickness of the polished polishing-desired layer is measured in a post-CMP metrology 13. Additionally, a semi-auto system 14, coupled to the three elements respectively, is used to control the parameters or conditions in the whole chemical-mechanical polishing process.

When the first lot of production wafers 10 is processed into the pre-CMP metrology 11, the semi-automated system then receives signal from the pre-CMP metrology 11 about the real pre-thickness $TK_{B1}$ of the polishing-desired layer such as oxide. In fact, there is easily a difference between the pre-thickness $TK_{B1}$ and the reference pre-thickness $TK_{B0}$ measured during the test run. The difference is named pre-variability, $\Delta TK_{B1}$. The CMP semi-automated system 14 then adds the reference removal thickness $TK_0$ to the pre-variability to get a desired removal thickness $TK_1$ for the first lot of production wafers. This is expressed by:

$$TK_1=TK_0+\Delta TK_{B1}$$

Subsequently, to predict the desired polishing time $T_1$, the desired removal thickness $TK_1$ should be divided by the last polishing rate (initial polishing rate $RR_0$ in this case). This is expressed by:

$$T_1=TK_1/RR_0$$

where $T_1$ is the polishing time for the first lot of production wafers in the chemical-mechanical polishing step. When the polishing step is completed, the first lot of production wafers is moved into a post-CMP metrology 13 to measure the thickness of the polishing-desired layer of each wafer, which is the so-called post-thickness $TK_{A1}$. Then the real polishing rate $RR_1$ for the chemical-mechanical polishing step can be calculated through the CMP semi-automated system 14. When the chemical-mechanical polishing goes on being implemented lot by lot, the polishing ability of the polishing pads set in the CMP apparatus will be reduced little by little due to consumption. Additionally, the impact of some elements such as pads or dressers in the integrated circuits substantially reduces the polishing rate too. That is, the polishing rate will not always be constant when the production wafers are polished lot by lot, even though they have the same structure and materials thereon. If the chemical-mechanical polishing step is implemented through the polishing rate of $RR_0$ until the thickness of the polishing-desired layer of the wafers is $TK_{Target}$, the desired polishing time is T. Accordingly, we can find the removal thickness $RR_0$*T. On the other hand, if the chemical-mechanical polishing step is implemented through the polishing rate of $RR_1$ for the same polishing time T, we can get the removal thickness $RR_1$*T. After being polished, the thickness of the polishing-desired layer is changed to $TK_{A1}$. The relationship can be expressed by:

$$\Delta TK_{A1}=TK_{A1}-TK_{Target}$$

$$RR_1*T=RR_0*T+\Delta TK_{A1}$$

If T indicates the polishing time $T_1$ desired by the first lot of production wafers, then the $RR_1$ can be found from:

$$RR_1=RR_0+\Delta TK_{A1}/T_1$$

where $\Delta TK_{A1}$ is so-called the post-variability for the first lot of production wafers. The last equation shows the relationship between $RR_1$ and $RR_0$, and the $RR_1$ will be used to find the next polishing time $T_2$ for the second lot of production wafers.

When the n-th lot of production wafers is performed in the chemical-mechanical polishing process, the CMP semi-automated system can find the necessary parameters from:

$$\Delta TK_{Bn}=TK_{Bn}-TK_{B0} \quad (1)$$

$$T_n=TK_n/RR_{n-1}=(TK_0+\Delta TK_{Bn})/RR_{n-1} \quad (2)$$

$$\Delta TK_{An}=TK_{An}-TK_{Target} \quad (3)$$

$$RR_n = RR_{n-1} + \Delta TK_{An} / T_n \quad (4)$$

$$= RR_{n-1} + (\Delta TK_{An} * RR_{n-1}) / (\Delta TK_{Bn} + TK_0)$$

where $T_n$ is the polishing time for the n-th lot of production wafers, $RR_n$ is the polishing rate and used to find out the $T_{n+1}$ applied to the next lot. The four equations are incorporated into the CMP semi-automated system and are generally used to find the desired polishing time for every lot of production wafers in the chemical-mechanical polishing process. Additionally, a database including the values of $RR_0$, $TK_0$, $TK_{Target}$ and $TK_{B0}$ was previously provided inside the CMP semi-automated system.

Due to the demand of desired higher and higher accuracy in semiconductor manufacture, there is the need to reduce the decination about the chemical-mechanical polishing process. This has become the future trend in the semiconductor industry. The timing module provided by the present invention can be used to find very accurate polishing time for every lot of production wafers, so that the efficiency of manufacturing can be enhanced and the cost of ownership will be reduced.

Although specific embodiments have been illustrated and described, it will be obvious to those skilled in the art that various modifications may be made without departing from what is intended to be limited solely by the appended claims.

What is claimed is:

1. A method for controlling polishing time in chemical-mechanical polishing process, comprising:

providing a first wafer, said first wafer including a first layer;

measuring the thickness of said first layer, the measuring result being a first pre-thickness, the difference between a reference pre-thickness and said first pre-thickness being a first pre-variability;

generating a first removal thickness by adding said first pre-variability to a reference removal thickness;

dividing said first removal thickness by an initial polishing rate to find a first polishing time, said first layer of said first wafer being treated by chemical-mechanical polishing for the period of said first polishing time;

measuring the thickness of said first layer, the measuring result being a first post-thickness, the difference between a target thickness and said first post-thickness being a first post-variability;

dividing said first post-variability by said first polishing time, the result then being added to said initial polishing rate to form a first polishing rate;

providing a second wafer, said second wafer including a second layer;

measuring the thickness of said second layer, the measuring result being a second pre-thickness, the difference between said reference pre-thickness and said second pre-thickness being a second pre-variability;

generating a second removal thickness by adding said second pre-variability to said reference removal thickness;

dividing said second removal thickness by said first polishing rate to find a second polishing time, said second layer of said second wafer being treated by chemical-mechanical polishing for the period of said second polishing time;

measuring the thickness of said second layer, the measuring result being a second post-thickness, the difference between said target thickness and said second post-thickness being a second post-variability; and dividing said second post-variability by said second polishing time, the result then being added to said first polishing rate to form a second polishing rate.

2. The method according to claim 1, wherein said initial polishing rate can be found from treating a dummy wafer by the chemical-mechanical polishing.

3. The method according to claim 1, wherein said first wafer includes a production wafer.

4. The method according to claim 1, wherein said first layer comprises oxide.

5. The method according to claim 1, wherein said second wafer includes production wafer.

6. The method according to claim 1, wherein said second layer comprises oxide.

* * * * *